US010309667B2

(12) United States Patent
Choo et al.

(10) Patent No.: US 10,309,667 B2
(45) Date of Patent: Jun. 4, 2019

(54) VENTILATOR

(71) Applicant: NANYANG TECHNOLOGICAL UNIVERSITY, Singapore (SG)

(72) Inventors: Fook Hoong Choo, Singapore (SG); Mohan Dass Ettanoor Thuppale, Singapore (SG)

(73) Assignee: NANYANG TECHNOLOGICAL UNIVERSITY, Singapore (SG)

( * ) Notice: Subject to any disclaimer, the term of this patent is extended or adjusted under 35 U.S.C. 154(b) by 390 days.

(21) Appl. No.: 14/906,015

(22) PCT Filed: Jul. 18, 2014

(86) PCT No.: PCT/SG2014/000344
§ 371 (c)(1),
(2) Date: Jan. 19, 2016

(87) PCT Pub. No.: WO2015/009245
PCT Pub. Date: Jan. 22, 2015

(65) Prior Publication Data

US 2016/0161134 A1 Jun. 9, 2016

Related U.S. Application Data

(60) Provisional application No. 61/856,192, filed on Jul. 19, 2013.

(51) Int. Cl.
*F24F 7/08* (2006.01)
*F04D 25/08* (2006.01)
*F04D 17/16* (2006.01)

(52) U.S. Cl.
CPC ..... *F24F 7/08* (2013.01); *F04D 17/16* (2013.01); *F04D 25/08* (2013.01); *F04D 25/088* (2013.01); *F24F 2221/14* (2013.01)

(58) Field of Classification Search
CPC combination set(s) only.
See application file for complete search history.

(56) References Cited

U.S. PATENT DOCUMENTS 3,221,632 A 12/1965 Copp
4,501,194 A 2/1985 Brown
(Continued)

FOREIGN PATENT DOCUMENTS

WO 2015009245 A1 1/2015

OTHER PUBLICATIONS

"Venturi." Merriam-Webster.com, Merriam-Webster, www.merriam-webster.com/dictionary/venturi. Accessed Nov. 16, 2017.*
(Continued)

*Primary Examiner* — Gregory L Huson
*Assistant Examiner* — Elizabeth M. May

(57) ABSTRACT

A ventilator comprising an air blower; a casing comprising a first wall and a second wall configured to house the air blower centrally and to define a radially decreasing volume therebetween, a circumferential gap between the first wall and the second wall configured to allow a high velocity air stream to exit and to spiral in a direction away from a structure to which the ventilator is configured to be mounted, and a central opening in the second wall configured as a suction inlet of the air blower; and a flow amplifier adjacent the casing and configured to amplify air flow through an air flow passage defined between the flow amplifier and the second wall of the casing.

10 Claims, 3 Drawing Sheets

(56) References Cited

U.S. PATENT DOCUMENTS

| | | | | |
|---|---|---|---|---|
| 4,597,193 | A * | 7/1986 | Kallfass | B65B 53/063 34/224 |
| 2003/0206796 | A1 | 11/2003 | Scholten | |
| 2010/0080719 | A1 | 4/2010 | Boggess, Jr. et al. | |
| 2010/0111720 | A1 | 5/2010 | Hiner | |
| 2012/0163972 | A1 | 6/2012 | Dyson et al. | |
| 2013/0323100 | A1* | 12/2013 | Poulton | F04F 5/16 417/423.14 |
| 2014/0348658 | A1* | 11/2014 | Cunnane | F04D 25/088 416/223 R |

OTHER PUBLICATIONS

Vorticity. Dictionary.com. Dictionary.com Unabridged. Random House, Inc. http://www.dictionary.com/browse/vorticity (accessed: Nov. 16, 2017).*

"Venturi", English Oxford Living Dictionaries, https://en.oxforddictionaries.com/definition/venturi, Accessed Jun. 14, 2018.*

Foreign Communication From a Related Counterpart Application, International Search Report and Written Opinion dated Sep. 5, 2014, International Application No. PCT/SG2014/000344 filed on Jul. 18, 2014.

* cited by examiner

VENTILATOR

CROSS-REFERENCE TO RELATED APPLICATIONS

This application is a filing under 35 U.S.C. 371 as the National Stage of International Application No. PCT/SG2014/000344, filed Jul. 18, 2014, entitled "A VENTILATOR," which claims the benefit of U.S. Provisional Application No. 61/856,192 filed on Jul. 19, 2013, both of which are incorporated herein by reference in its entirety for all purposes

FIELD OF THE INVENTION

This invention relates to a ventilator, in particular to a ventilator for ventilating/cooling a space.

BACKGROUND OF THE INVENTION

Current space cooling technologies employ an electric motor (dc or ac) to turn a set of blades that are inclined to their plane of rotation. The movement of inclined blades impinging on the column of stationary air provides pressurized air movement towards an object/person or surface to induce cooling by natural evaporation. These fan technologies can be ceiling-mounted, wall-mounted or standing, and air-flow is controlled by controlling speed of the motor. For wall-mounted and standing fans, air-flow direction can be oscillated by using another motor or reduction gear train to rotate the main motor blade assembly. However, ceiling-mounted units have fixed air-flow direction and air is directed from the top, i.e., the ceiling, to a user sitting below. Such bladed ceiling fans and wall-mounted fans have serious drawbacks and one of the disadvantages is the pushing of hot air from the ceiling to the user below. This technology has not changed since its invention some hundred years ago. This type of air movement is very energy inefficient aerodynamically.

Recent development in fan technology has resulted in a 'No Visible Blades" fan invented by Sir James Dyson and being sold under the same name. The Dyson fan with a blower concealed in the circular body of its stand forces pressurized air through an annulus slit near the leading edge of an aerofoil surface to draw secondary air. This type of fan has the advantage that it is perceived as 'Bladeless' and safe. Being a new product based on a novel concept, it is currently very expensive and comes as a standing fan design. The novelties are the use of the aerofoil to draw secondary air amplifying the total air-flow and the concealed blades design.

SUMMARY OF INVENTION

The present invention falls in the domain of space cooling and is based on a totally novel concept, namely, "Induced Vortex," mimicking the natural phenomenon of tornados but in a controlled manner to induce amplified air-flow for space cooling. In nature, hot air rises while cold air sinks. The invention lifts cold air from the floor level to be funnelled up, amplified and distributed over the user(s) or occupant(s) through an entirely new three-dimensional (3-D) vortex air flow pattern.

According to an exemplary aspect, there is provided a ventilator comprising an air blower; a casing comprising a first wall and a second wall configured to house the air blower centrally and to define a radially decreasing volume therebetween, a circumferential gap between the first wall and the second wall configured to allow a high velocity air stream to exit and to spiral in a direction away from a structure to which the ventilator is configured to be mounted, and a central opening in the second wall configured as a suction inlet of the air blower; and a flow amplifier adjacent the casing and configured to amplify air flow through an air flow passage defined between the flow amplifier and the second wall of the casing.

The air flow passage may have a constant flow cross section.

The flow amplifier may be configured such that during operation, negative pressure is felt at an inlet of the air flow passage and at an outlet of the airflow passage.

The flow amplifier may comprise a flow amplifying wall provided in parallel with the second wall of the casing.

The first wall, the second wall and the flow amplifying wall may be circular.

The flow amplifier may form a venturi with the first wall.

When the ventilator is oriented such that the first wall is above the second wall, an outer annulus of the first wall may slope downwardly in the radial direction and an outer annulus of the second wall may slope upwardly in the radial direction.

The first wall may have a greater diameter than the second wall.

The flow amplifier may be configured to mingle amplified air exiting the air flow passage with the high velocity air stream exiting the circumferential gap.

The high velocity air stream may have vorticity and direction controllable by a speed of the blower.

During operation, air may be drawn towards the suction inlet of the blower along a central axis of the ventilator.

The first wall may be configured for mounting the ventilator to the structure, the structure being at least one of: a ceiling, a wall and a stand.

BRIEF DESCRIPTION OF FIGURES

In order that the invention may be fully understood and readily put into practical effect there shall now be described by way of non-limitative example only exemplary embodiments of the present invention, the description being with reference to the accompanying illustrative drawings.

DETAILED DESCRIPTION

Figure 1:
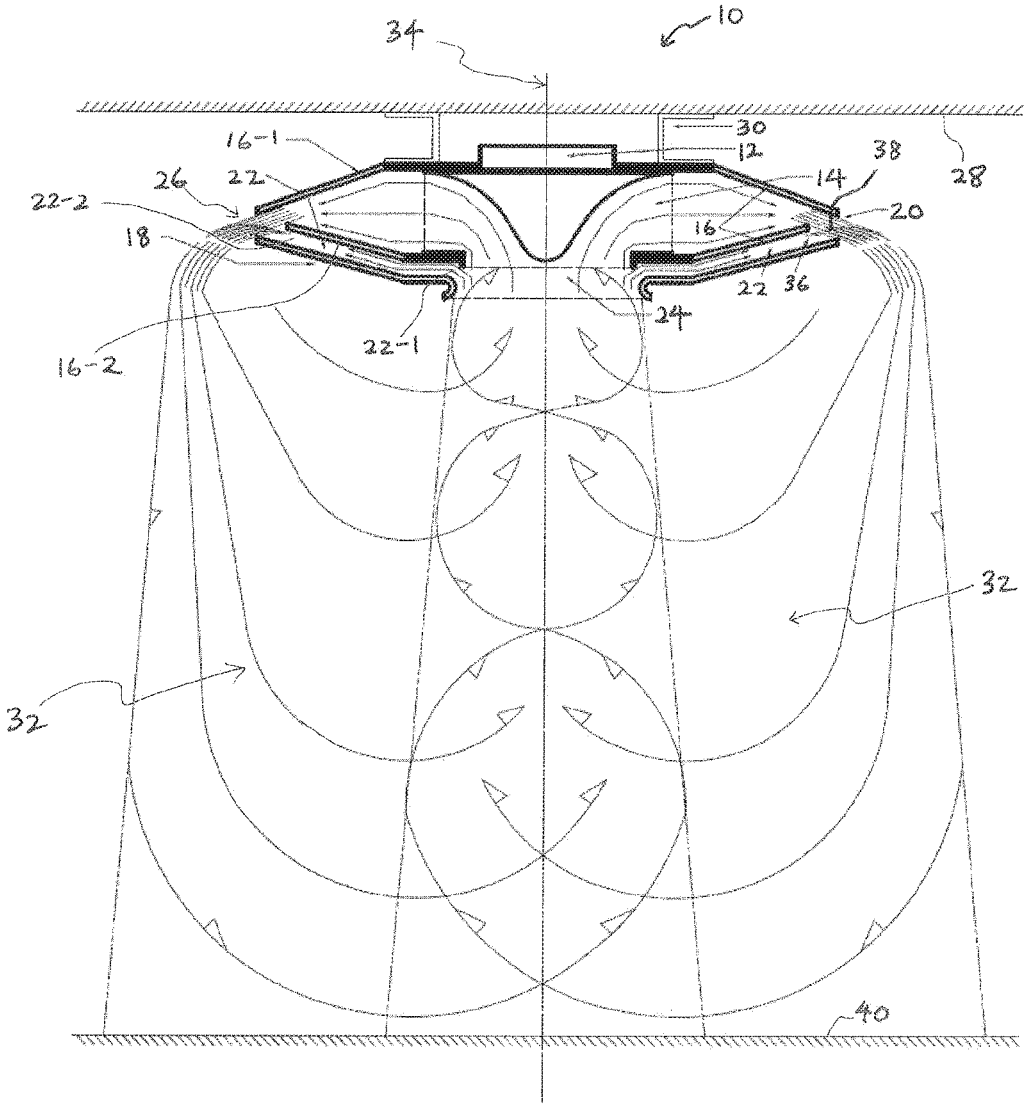
FIG. 1 is a schematic side view of the ventilator for space cooling.

Exemplary embodiments of the invention will be described with reference to FIGS. 1 to 3 below.

The vortex ventilator 10 comprises an electric motor 12, preferably dc-brushless, driving an aerodynamically efficient back swept design 15 air blower 14 encased in a circular but radially narrowing casing 16. The air blower 14 comprises a plurality of back-swept blades 15 with reference to the direction of rotation as shown by arrow 50 in FIG. 2. The blower 14 is located centrally within the casing 16, and is configured to blow air in a radial direction.

The casing 16 comprises a circular first wall 16-1 and a circular second wall 16-2 having a common central axis 34 and configured to house the blower 14 centrally therein and to define a radially decreasing volume between the first wall

16-1 and the second wall 16-2. The first wall 16-1 is configured for mounting 30 the ventilator 10 to a ceiling 28 or other appropriate structure. In one embodiment when the ventilator 10 is oriented such that the first wall 16-1 is above the second wall 16-2, as shown in FIGS. 1 and 2, the first wall 16-1 is configured as a circular upper or top wall 16-1 having an outer annulus sloping downwardly in the radial direction while the second wall 16-2 is configured as a circular lower or bottom wall 16-2 having an outer annulus sloping upwardly in the radial direction. Central portions of the first wall 16-1 and the second wall 16-2 preferably remain in the horizontal plane.

Outer rims of both the first wall 16-1 and second wall 16-2 are spaced apart from each other, thereby defining a circumferential gap 26 in the casing 16 to allow the exiting of high velocity air stream 20 from the casing 16, as generated by the blower 14. The circumferential gap 26 is configured such that the high velocity air stream 20 exits the casing 16 and spirals in direction away from ceiling or other structure to which the first wall 16-1 is mounted, thereby inducing a 3D vortex. Where the ventilator 10 is mounted to a ceiling 28, the high velocity air stream 20 exits the casing at a downward angle to the horizontal plane as well as in a spiral flow downward, resulting in a spiralling down draught indicated by arrows 300 in FIG. 3. This may be achieved, for example, by configuring the circular first wall 16-1 to have a greater diameter than the circular second wall 16-2 as shown in FIGS. 1 and 2. The second wall 16-2 is provided with a central circular opening 24 to serve as a suction inlet 24 of the blower 14. The casing 16 thus acts as an air collector through the suction inlet 24 as well as a circumferential venturi 26 via the circumferential gap 26.

Arranged adjacent to the casing 16, in parallel with the second wall 16-2, is another circular wall or flow amplifying wall 18 defining an annular air flow passage 22 of constant flow cross section that is parallel with the second wall 16-2. Similar to the second wall 16-2, the flow amplifying wall 18 has a central opening to allow air passage into the suction inlet 24 of the blower 14. The flow amplifying wall 18 serves as a flow amplifier to amplify flow 36 through the air flow passage 22. The flow amplifying wall 18 connects the circumferential annulus venturi 26 with the suction opening or suction inlet 24 of the blower 14.

Figure 2:
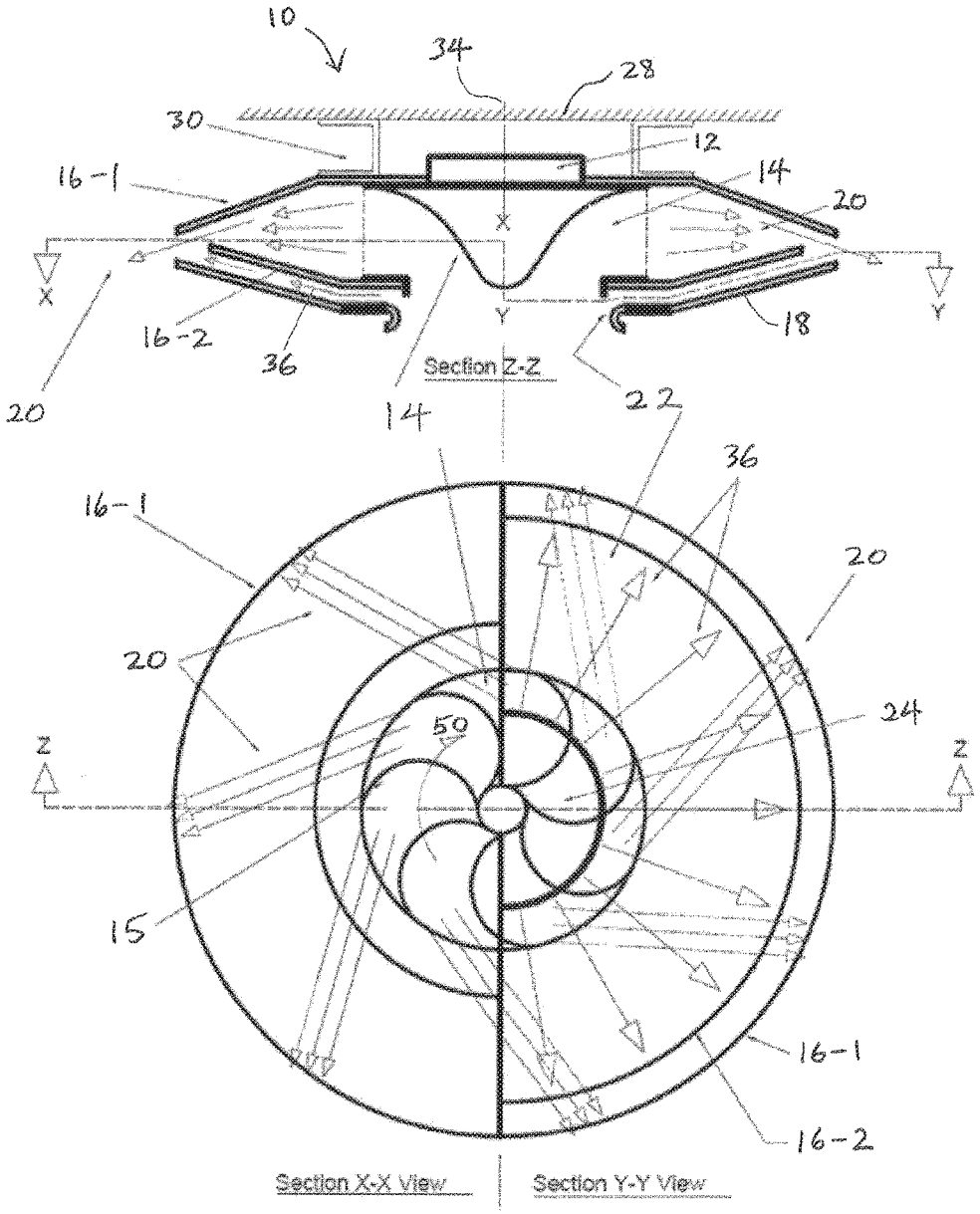
FIG. 2 is a set of sectional views of the ventilator of FIG. 1.

In the embodiment shown in FIGS. 1 and 2, the flow amplifying wall 18 is circular and forms a venturi with the first wall 16-1 so that part of the total energy is converted to velocity at the venturi throat 38 and consequent negative pressure at the throat 38. Reduction in static pressure at the throat 38 thus draws additional air through passage 22, resulting in amplified flow 36 exiting the air flow passage 22 that mingles with the high velocity air stream exiting the circumferential gap 26 of the casing 16.

The ventilator 10 may be mounted onto a ceiling 28 by means of mounting brackets provided between the first wall 16-1 of the casing 16 and the ceiling 28.

Electrical energy supplied to the motor 12 is converted into kinetic energy in the form of the high velocity air stream 20 generated by the blower 14 and discharged uniformly through the annulus venturi 26. This high velocity spiralling but downward flowing air stream 20 is the induced three-dimensional (3-D) vortex 32 whose vorticity and direction are controllable by the speed of the blower 14 and/or by iris shutters (not shown) as an option.

Figure 3:
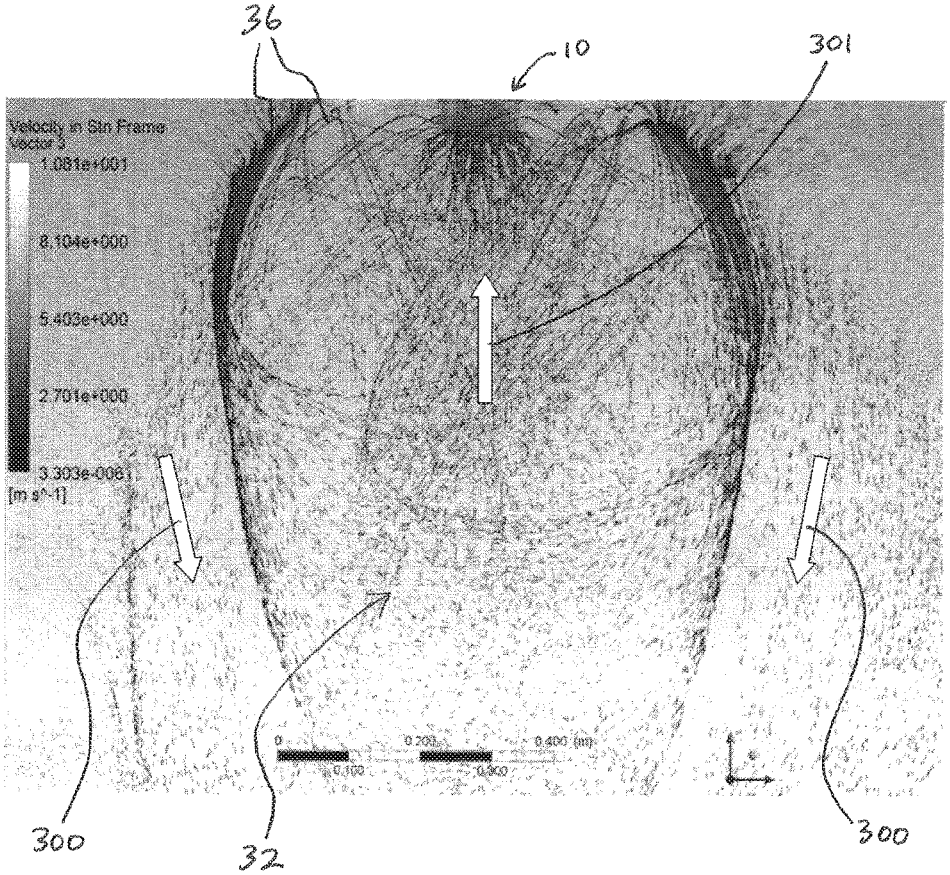
FIG. 3 is a simulated computational fluid dynamics (CFD) air flow of the ventilator of FIGS. 1 and 2 in operation.

As the air hits the floor 40, lower pressure created at the suction inlet 24 of the blower 14 will help to sustain negative pressure in the core of the 3-D vortex 32 that is along the central axis 34 of the ventilator 10, but with a change in direction upwards, resulting in a spiralling up draught as indicated by arrow 301 in FIG. 3. The positive feedback of air flow back upwards along the central axis 34 to the blower 14 further helps to sustain the continuous flow of the vortex 32. This change in direction of the vortex 32 and positive feedback is the essence in this invention that gives rise to a more effective low-cost natural cooling and the optimisation of the blower 14 performance.

Negative pressure at the blower inlet 24 will also be felt at the start 22-1 of the air flow passage 22 (at the central opening of the circular wall 18) communicating with the venturi annulus 26. Similar negative pressure will also be felt at the end 22-2 of the flow passage 22. These differential pressures induce air flow through the flow passage 22 but at a higher magnitude as compared to that of the air flowing through the blower 14. This is the novel dynamic of flow amplification 36. This amplification 36 reduces the energy needed to sustain the upward draft and the downward draft of the vortex 26. This together with the electronically controlled dc-brushless motor 12 allow the vortex ventilator 10 energy consumption to be minimized under various operating/load condition.

The profile and the strength of the vortex 32 are determined by the design of the motor 12, the casing blower 14 and the casing 16. The flow amplification is determined by the design and positioning of the flow passage 22. In this ventilator, unlike a conventional space cooling fan system, the foot print of the air flow does not depend on the enclosure like walls; instead, cool air is drawn from ground level 40, amplified and distributed without mixing with the strata of hot air just below the ceiling 28 or just above the vortex ventilator 10.

In addition, by incorporating optimally designed guide vanes (not shown) in the venturi annulus 26 and circular "Iris" shaped louvers (not shown) at the periphery of the venturi annulus 26, it would be possible to control the vortex envelop in profile and strength to a small foot print similar to localised personal lighting.

By shape and design, the vortex ventilator 10 lends itself to fit ceiling lights (both pendant and down lights), air ionizing electrodes, heating coils (electric), Peltier effect (for cooling) elements, etc., integral with the unit and rotating elements totally sealed from harm's way. The final commercial product will include the necessary embedded controls and remote operability for comfort and energy efficiency.

Significant novelties of this invention are (i) the design of an air handling system 10 to bring about a controlled three dimensional vortex 32 generation that can lift cooler air from the floor level 40 and distributing it evenly onto occupants below to induce evaporative cooling; and (ii) to convert some of the kinetic energy of the air flowing through the blower unit 14 into negative pressure to induce parallel air flow of several magnitudes, thus achieving air flow amplification 36 and better air flow gain per kilowatt hour electrical energy used.

Unlike conventional ceiling fans which can only force hot air from the top onto the occupant and relying on the room geometry to circulate the internal air, this invention allows air to be circulated in a controlled vortex manner regardless of the room or space geometry. It is hence also suitable for outdoor applications. Another novel feature of this invention is its ability to control the vortex area foot print to concentrate the cool air onto a small foot print (group of users) or a larger foot print (bigger group of users). This flexibility leads to energy saving as the output power of the motor can be substantially reduced by this innovative means of channelling the air-flow via the vortex to a dedicated area. This invention allows energy efficient dedicated cooling similar to that of dedicated task lighting. The ventilator 10 not only sucks in the cool air from the vortex but also amplifies the air flow many times, drawing more cool air outside the eye of the upward draft of the inner core of the three dimensional vortex 32 and throwing the cool air onto the downward draft of the same vortex 32, increasing the air handling efficiency of the overall system 10.

As add-ons, it is possible to integrate ceiling lights (pendant and down lights), air ionizing electrodes, heating coils (electric), Peltier effect (for cooling) elements, etc., without shadow effects and for a more uniform and natural dispersion effect respectively.

Advantages of the present invention and improvements over existing space cooling methods and devices are given below:

More energy efficient natural cooling system.

Controllable cooling space (volume) foot print.

Can be integrated with modern cooling systems such as active-chilled beam and cool ceiling for air-conditioning Suitable for both indoor and outdoor use—does not depend on space geometry.

Allows air stratification—does not blow down hot air unlike conventional fans.

Better air flow distribution and cooling effect (rotating air draft as compared to direct) than existing bladed fans.

Space lighting can be integrated without shadow effect

No exposed rotating parts, hence safer than existing ceiling fans

Flexible to add optional features without affecting the original function

No height constraints in deployment

Commercialization of this invention is targeted at the tropical ceiling fan markets as well as at outdoor applications like food courts and hawker centres. The scalability and flexibility of the invention also allow smaller systems scaled to suit personalized targeted cooling as in the case of car interiors or as a hybrid table lamp cum space cooling/heating or as a hybrid task lighting and local space cooling/heating. The invention can create air stratification, lifting cool air from lower levels to the level of the blower, hence allowing the system to be installed at any height. As the system does not have exposed rotating parts, unlike that of conventional ceiling fans, proximity of the blower unit 14 is not a serious safety issue and hence would be ideal for low ceiling tropical flats and apartments. This invention can be applied as designer lighting with cooling gadget for interior decoration and design suitable for homes and commercial buildings since both pendant lighting and down lighting can be integrated with the vortex ventilator 10 without shadowing effects. For large space cooling and air-conditioning applications, this invention can be easily incorporated into the latest active chilled beam and cool ceiling technologies. It can also be hung over a small pond or fountain to induce further cooling effect from evaporative cooling generating a gentle spiralling breeze in gardens and other similar settings. Where appropriate, it can also be mounted on a wall or even as a standing unit to exploit the spiralling gentle breeze generated by the vortex ventilator 10 to pick up the cooler air near the surface.

Whilst there has been described in the foregoing description exemplary embodiments of the present invention, it will be understood by those skilled in the technology concerned that many variations in details of design, construction and/or operation may be made without departing from the present invention. For example, while a back swept design air blower has been described, blowers having other designs may be used. Other possible variations include blowers with forward swept, straight vanes, complex vanes involving straight and curve vanes, and compound vanes.

The invention claimed is:

1. A ventilator comprising:

an air blower;

a casing comprising a first wall and a second wall configured to house the air blower centrally and to define a radially decreasing volume therebetween, a circumferential gap between the first wall and the second wall configured to allow a high velocity air stream to exit and to spiral in a direction away from a structure to which the ventilator is configured to be mounted, and a central opening in the second wall configured as a suction inlet of the air blower; and a flow amplifier adjacent the casing, the flow amplifier comprising a flow amplifying wall provided in parallel with the second wall of the casing and is configured to amplify air flow through an air flow passage defined between the flow amplifying wall and the second wall of the casing.

2. The ventilator of claim 1, wherein the air flow passage has a constant flow cross section.

3. The ventilator of claim 1, wherein the first wall has a greater diameter than the second wall.

4. The ventilator of claim 1, wherein the flow amplifier is configured to mingle amplified air exiting the air flow passage with the high velocity air stream exiting the circumferential gap.

5. The ventilator of claim 1, wherein the high velocity air stream has vorticity and direction controllable by a speed of the blower.

6. The ventilator of claim 1, wherein, during operation, air is drawn towards the suction inlet of the blower along a central axis of the ventilator.

7. The ventilator of claim 1, wherein the first wall is configured for mounting the ventilator to the structure, the structure being at least one of: a ceiling, a wall and a stand.

8. The ventilator of claim 1, wherein the first wall, the second wall and the flow amplifying wall are circular.

9. The ventilator of claim 8, wherein the flow amplifying wall forms a constricted section with the first wall.

10. The ventilator of claim 8, wherein, when the ventilator is oriented such that the first wall is above the second wall, an outer annulus of the first wall slopes downwardly in the radial direction and an outer annulus of the second wall slopes upwardly in the radial direction.

* * * * *